US008684773B2

(12) United States Patent
Kobayashi et al.

(10) Patent No.: US 8,684,773 B2
(45) Date of Patent: Apr. 1, 2014

(54) CONNECTOR

(75) Inventors: Tohru Kobayashi, Makinohara (JP); Shoji Yamamoto, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/811,053

(22) PCT Filed: Jul. 20, 2011

(86) PCT No.: PCT/JP2011/067014

§ 371 (c)(1),
(2), (4) Date: Jan. 18, 2013

(87) PCT Pub. No.: WO2012/011604

PCT Pub. Date: Jan. 26, 2012

(65) Prior Publication Data

US 2013/0115801 A1 May 9, 2013

(30) Foreign Application Priority Data

Jul. 20, 2010 (JP) ..... 2010-162459

(51) Int. Cl.
*H01R 13/514* (2006.01)

(52) U.S. Cl.
USPC ..... 439/752

(58) Field of Classification Search
USPC ..... 439/257, 752
See application file for complete search history.

(56) References Cited

U.S. PATENT DOCUMENTS 6,767,231 B1 * 7/2004 Martin et al. ..... 439/157
7,014,511 B2 * 3/2006 Sagawa et al. ..... 439/752
7,488,190 B2 * 2/2009 Takahashi et al. ..... 439/157
7,524,200 B2 * 4/2009 Ikeya et al. ..... 439/157
2001/0012711 A1 * 8/2001 Sasaki et al. ..... 439/157
2006/0264081 A1 11/2006 Osada et al.
2007/0167088 A1 7/2007 Ohtaka et al.
2011/0183551 A1 * 7/2011 Hirano ..... 439/752

FOREIGN PATENT DOCUMENTS

JP 2007-188783 A 7/2007

OTHER PUBLICATIONS

International Search Report (PCT/ISA/210) dated Oct. 21, 2011, issued by the International Searching Authority in International Application No. PCT/JP2011/067014.

Written Opinion (PCT/ISA/237) dated Oct. 21, 2011, issued by the International Searching Authority, in International Application No. PCT/JP2011/067014.

* cited by examiner

*Primary Examiner* — Phuong Dinh
(74) *Attorney, Agent, or Firm* — Sughrue Mion, PLLC

(57) ABSTRACT

There is provided a lever type connector including a positioning lock provided in a lever and a jig pressing space in the positioning lock. A spacer pressing surface is in symmetrical position to the jig pressing space with respect to a center line of the lever that intersects orthogonally with the jig passing space in a longitudinal direction of a spacer. A terminal is inserted in a state that the spacer and the lever are attached to a connector housing, then the terminal is held in a temporarily latching state, and then the spacer pressing surface is pushed down by a jig and thus the terminal is held in a normally latching state. The spacer pressing surfaces is configured to be pushed by pushing pins which are provided on the jig in bilaterally symmetrical positions with respect to a center line that intersects orthogonally with the longitudinal direction.

2 Claims, 11 Drawing Sheets

CONNECTOR

TECHNICAL FIELD

The present invention is related to a lever type connector for retaining terminals, which are inserted into a connector housing, by a spacer.

BACKGROUND ART

In the lever type connector as shown in PTL 1, a female connector 10 and a male connector 30 are coupled and locked mutually by using a set of female and male connector housings 11, 31. Also, when the turning operation of a lever 40 which is fitted turnably to an inner housing 11a of the female connector 10 is executed, the connector housings 11, 31 of the female connector 10 and the male connector 30 are coupled and decoupled mutually.

Then, in PTL 1, a protection wall 13 protects the lever 40 and a lock arm 12. A retainer insertion port 13a is provided in the protection wall 13, and a retainer 70 performing as a secondary retaining member of female terminals 17 is inserted into the retainer insertion port 13a.

Also, temporarily retaining jig insertion holes 19 and normally retaining jig insertion holes 20 are provided to an electric wire leading surface of the inner housing 11a of the female connector 10, which is located on the opposite side to the fitting surface to the male connector 30, respectively along the insertion direction of the female terminals 17 into the inner housing 11a of the female connector 10.

In PTL 1, the retainer 70 is inserted from the retainer insertion port 13a in the protection wall 13 of an outer housing 11b of the protection wall 13, and then is contained in a retainer containing portion 21 provided in the inner housing 11a of the female connector 10. The retainer 70 enables the female terminals 17 to be inserted into the inner housing 11a of the female connector 10 in such a state that the retainer 70 is retained in a predetermined temporarily retaining position to the inner housing 11a of the female connector 10 in the retainer containing portion 21, while the retainer 70 retains the female terminals 17 in the inner housing 11a of the female connector 10 in such a state that the retainer 70 is displaced into a predetermined normal retaining position.

CITATION LIST

Patent Literature

[PTL 1] JP-A-2007-188783

SUMMARY OF INVENTION

Technical Problem

In the above manner, in a case where the temporarily retaining jig insertion holes 19 and the normally retaining jig insertion holes 20, which are used to temporarily retain and normally retain the female terminals 17 by the retainer 70, are provided and also the retainer 70 is temporarily retained and normally retained by a retainer operating jig 60, the insertion direction of the retainer 70 and the insertion direction of the retainer operating jig 60 are different mutually. Therefore, the retainer 70 cannot be operated in the condition that any obstacle is present on the insertion side of the retainer 70 and the insertion side of the retainer operating jig 60. For example, in a case where the fitting position of the lever 40 should be changed, the insertion side of the retainer 70 or the insertion side of the retainer operating jig 60 cannot be ensured in some cases.

In the conventional lever type connector, the retainer 70 used to temporarily retain and normally retain the female terminals 17 can be inserted from the retainer insertion port 13a, but the retainer 70 cannot be pushed into the inside from the insertion direction side of the retainer 70.

It is therefore one advantageous aspect of the present invention to provide a lever type connector capable of preventing such a situation that a housing connector is scratched by a jig, which is used to push a spacer into an inside from the spacer insertion side, even though either right and left sides of the spacer insertion jig are mixed up or a fitting direction of a lever is set wrong when the spacer is to be pushed into the inside by using the spacer insertion jig.

Solution to Problem

According to one advantage of the invention, there is provided a lever type connector, comprising:

a connector housing, configured to be engaged with a mating connecter housing;

a spacer;

a lever, including a cam groove, and turnably attached to the connector housing;

a terminal, configured to be inserted into a rear end surface of the connector housing from a rear side;

a positioning lock, provided in the lever, and configured to temporarily fix the lever to be attached to the connector housing;

a jig pressing space, formed in the positioning lock;

a spacer pressing surface, provided on an upper side of the spacer, formed in symmetrical position to the jig pressing space with respect to a center line of the lever that intersects orthogonally with the jig passing space in a longitudinal direction of the spacer, wherein the connector housing is configured to be coupled and decoupled with the mating connecter housing in accordance with a displacement of a cam pin provided in the mating connecter housing along the cam groove by a turning operation of the lever, and wherein the terminal is inserted into the rear end surface in a state that the spacer and the lever are attached to the connector housing, then the terminal is held in a temporarily retaining state by the spacer, and then the spacer pressing surface is pushed down by a jig and thus the terminal is held in a normally retaining state by the spacer, wherein the spacer pressing surfaces is configured to be pushed by pushing pins which are provided on the jig in bilaterally symmetrical positions with respect to a center line that intersects orthogonally with the longitudinal direction of the spacer.

The lever may be fitted to sandwich the connector housing therein vertically. An arrangement of an upper surface and an arrangement of a lower surface may be constructed symmetrically with respect to a center plane of a sandwiching structure.

Advantageous Effects of Invention

According to the present invention, even though the right and left directions of the jig are mixed up and the jig is used laterally reversely, the spacer can be inserted correctly and thus such a situation can be prevented that the connector is scratched.

According to the present invention, even when the fitting direction of the lever is changed, the spacer can be correctly inserted without consideration of the fitting direction of the lever and without consideration of the lateral direction of the jig in use, and thus such a situation can be prevented that the connector is scratched.

DESCRIPTION OF EMBODIMENTS

A lever type connector is equipped with a connector housing, a spacer, a lever, and terminals. The lever is constructed such that its fitting direction can be reversed bilaterally or vertically. A positioning lock provided to the lever is retained in a lock retaining portion of the connector housing to fix the lever temporarily. Four pushing pins are provided to the top end of the jig, and also four pushing pins of the jig are set in the same positions as spacer pushing surfaces of the spacer to be bilaterally symmetrical.

In order to retain female terminals that are contained correspondingly in terminal containing cells of the connector housing, a retainer (spacer) is used in the conventional lever type connector. Then, when the female terminals are retained by this retainer, the temporary retaining and the normal retaining of the retainer are executed by inserting a retainer operating jig into the temporary retaining jig insertion holes and the normal retaining jig insertion holes, which are provided on the terminal containing cells side of the connector housing respectively.

Inventors of this case comes up with such an approach that the spacer should be normally retained by pushing the spacer into the inside from the spacer insertion port side while using the jig, based on the method in which the temporary retaining and the normal retaining of the retainer are done by inserting the retainer operating jig through the temporary retaining jig insertion holes and the normal retaining jig insertion holes in the conventional lever type connector.

Figure 10:
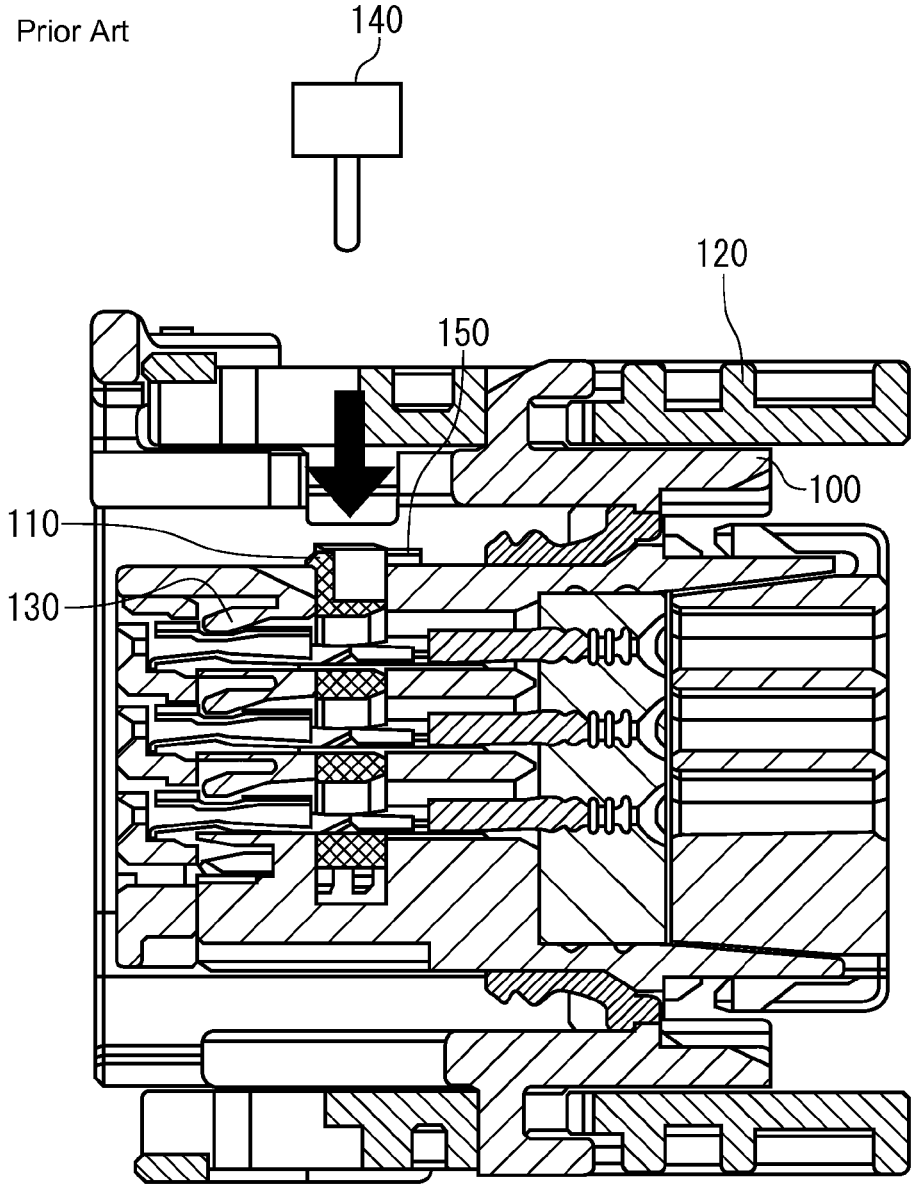
FIG. 10 Prior Art
FIG. 10 is a sectional view showing such a state that a spacer of a lever type connector in the prior art is held in a temporarily retained state.
Figure 11:
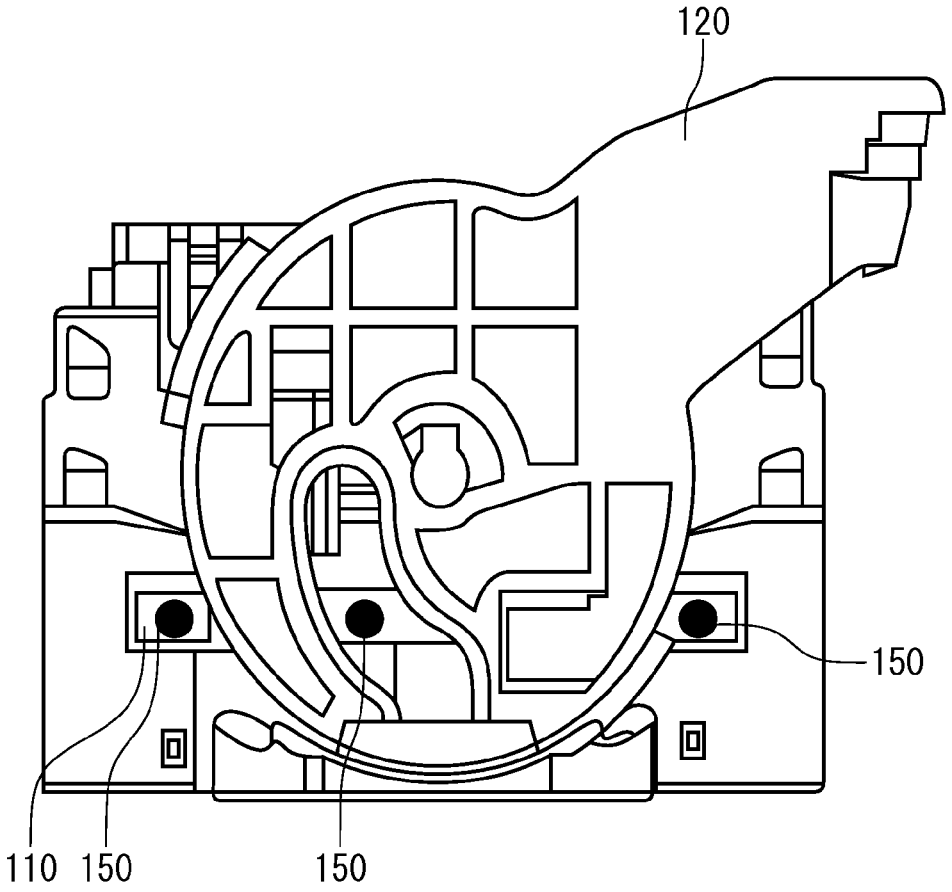
FIG. 11 Prior Art
FIG. 11 is a view showing positions in which a jig is pushed against a spacer of the lever type connector in the prior art respectively.

More particularly, as shown in FIG. 10, a spacer 110 is temporarily retained in a connector housing 100 in a state that the spacer 110 and a lever 120 are attached to the connector housing 100. This spacer 110 is pushed into the inside when an upper surface of the spacer 110 is pushed in the arrow direction by using a jig 140. The spacer 110 is held in a temporarily retained state by female terminals 130 since the spacer 110 is pushed into the inside by the jig 140. Then, the jig 140 is inserted in the arrow direction and then is pushed further downward while putting pushing pins 160 of the jig 140 on spacer pushing surfaces 150 shown in FIG. 11 respectively, and thus the spacer 110 is regularly retained in the connector housing 100.

In this manner, the pushing pins 160 are put on the spacer pushing surfaces 150 of the spacer 110 by using this jig 140, and then the spacer 110 is pushed downward. Thus, the regular retaining of the spacer 110 can be attained without the provision of the temporarily retaining jig insertion holes and the regularly retaining jig insertion holes. Then, the spacer pushing surfaces 150 of the spacer 110 are arranged on the fitting surface side on which the lever 120 is fitted. As a result, since the lever 120 is provided, positions of the spacer pushing surfaces 150 in which the jig 140 is pushed against the spacer 110 are limited to three locations.

For this reason, the spacer pushing surfaces 150 that exist only at three locations must be pushed downward by the jig 140 from the upper side of the connector housing 100. However, the spacer pushing surfaces 150 that exist at three locations are arranged bilaterally asymmetrically with respect to the line that passes through a middle point of the jig 140 in the lengthwise direction and intersects with the lengthwise direction of the jig 140. Therefore, when the lever 120 is attached bilaterally reversely, the jig cannot be inserted into the connector housing 100, and thus the jig must be newly set once again.

Also, such a problem arises that, when the jig 140 is used bilaterally reversely, the spacer 110 cannot be correctly inserted, and further it is feared that the connector housing 100 is scratched.

Moreover, such a problem arises that, when the fitting direction of the lever 120 is not taken into consideration under the condition that the fitting direction of the lever 120 is set wrong or the condition that the fitting direction of the lever 120 is changed and thus the jig 140 was used while setting reversely right and left sides of this jig, the spacer 110 cannot be correctly inserted, and further it is feared that the connector housing 100 is scratched.

Therefore, inventors of this case comes up with an invention of the lever type connector that is capable of preventing such a situation that the housing connector is scratched by the spacer inserting jig even though either right and left sides of the spacer inserting jig are mixed up or a fitting direction of the lever is set wrong when the spacer is to be pushed into the inside from the spacer insertion side by using the spacer inserting jig.

Next, an embodiment of the invention will be explained with reference to FIGS. 1 to 9 hereinafter.

Figure 1:
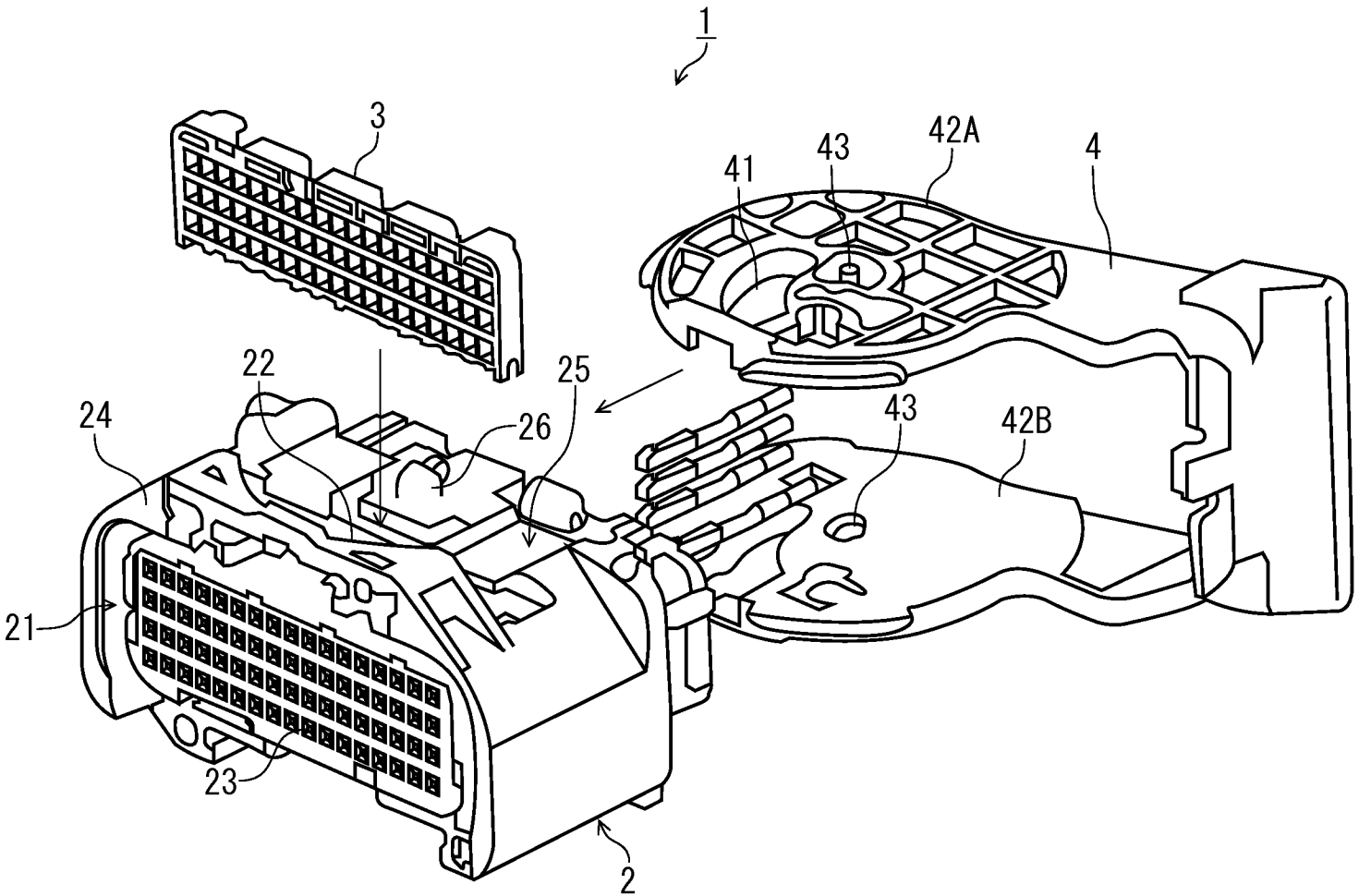
FIG. 1 is an exploded perspective view showing a lever type connector according to an embodiment of the present invention.
Figure 2:
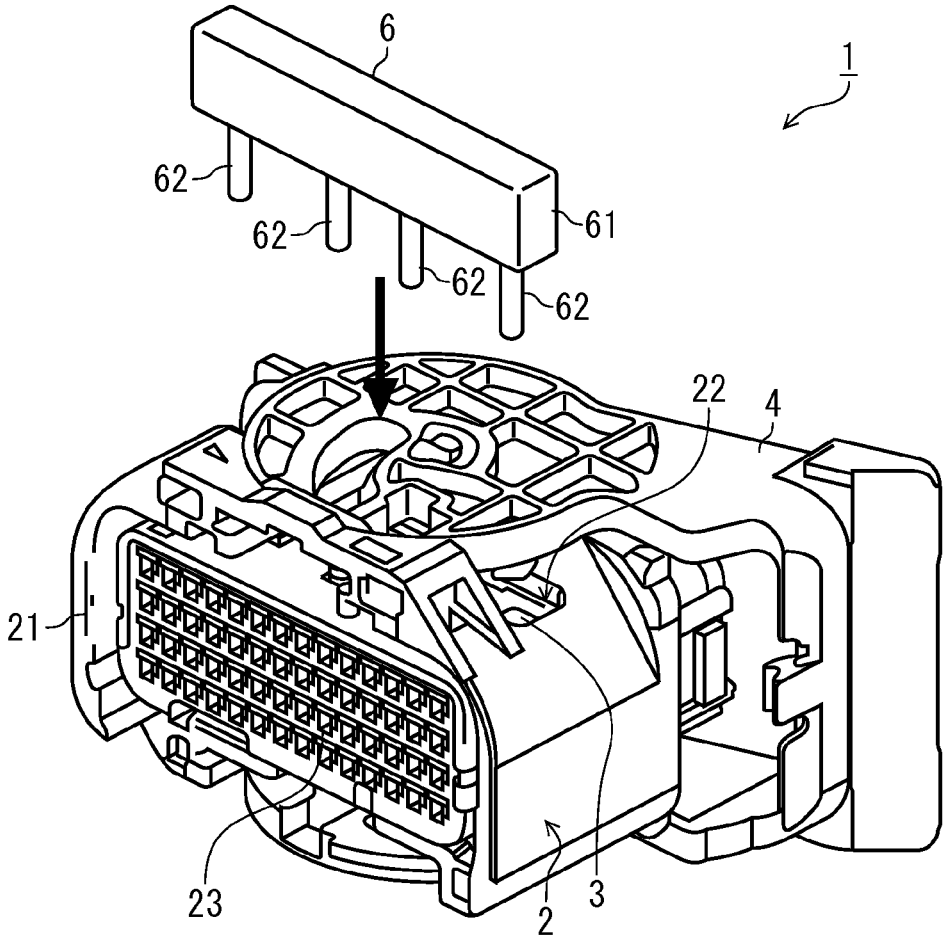
FIG. 2 is a perspective view explaining the use of a jig in a state that the lever type connector shown in FIG. 1 is fitted.
Figure 3:
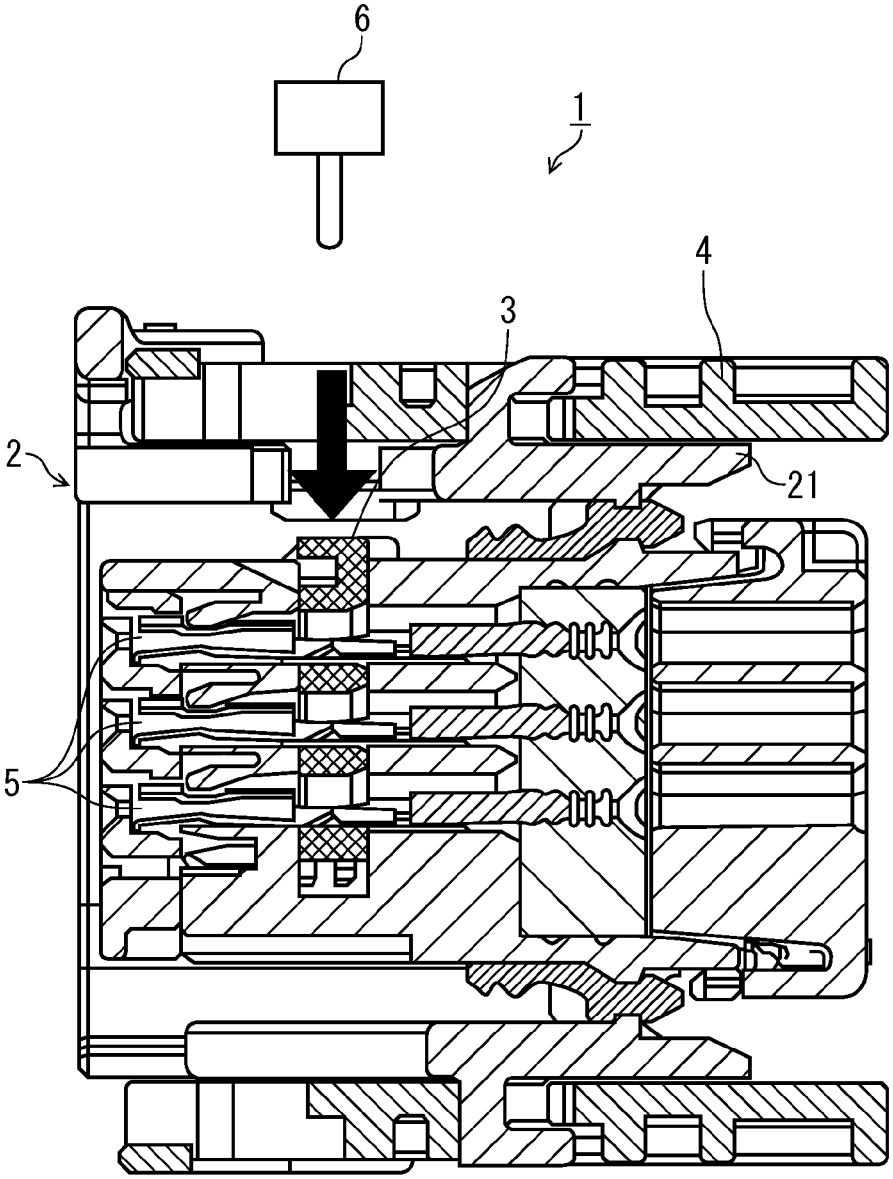
FIG. 3 is a sectional view showing such a state that a spacer of the lever type connector shown in FIG. 1 is temporarily retained.
Figure 4:
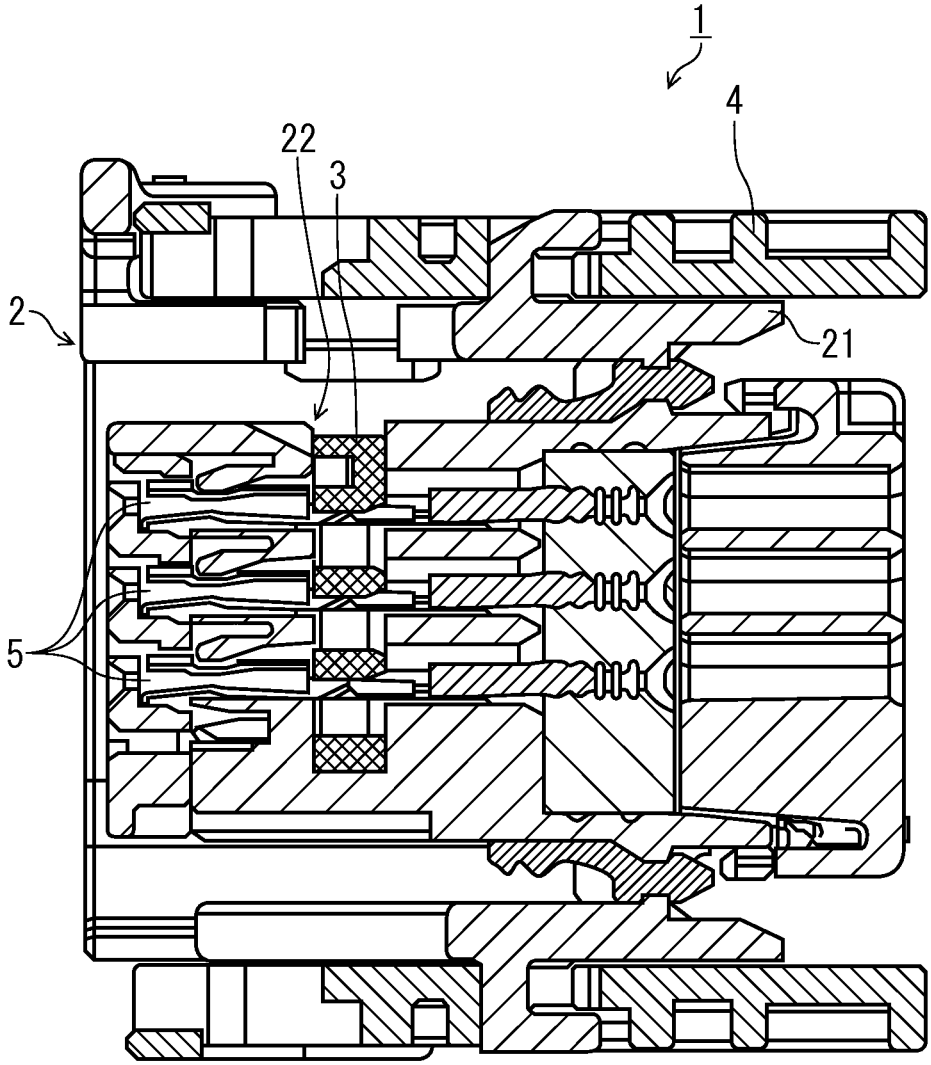
FIG. 4 is a sectional view showing such a state that a spacer of the lever type connector shown in FIG. 1 is regularly retained.
Figure 5:
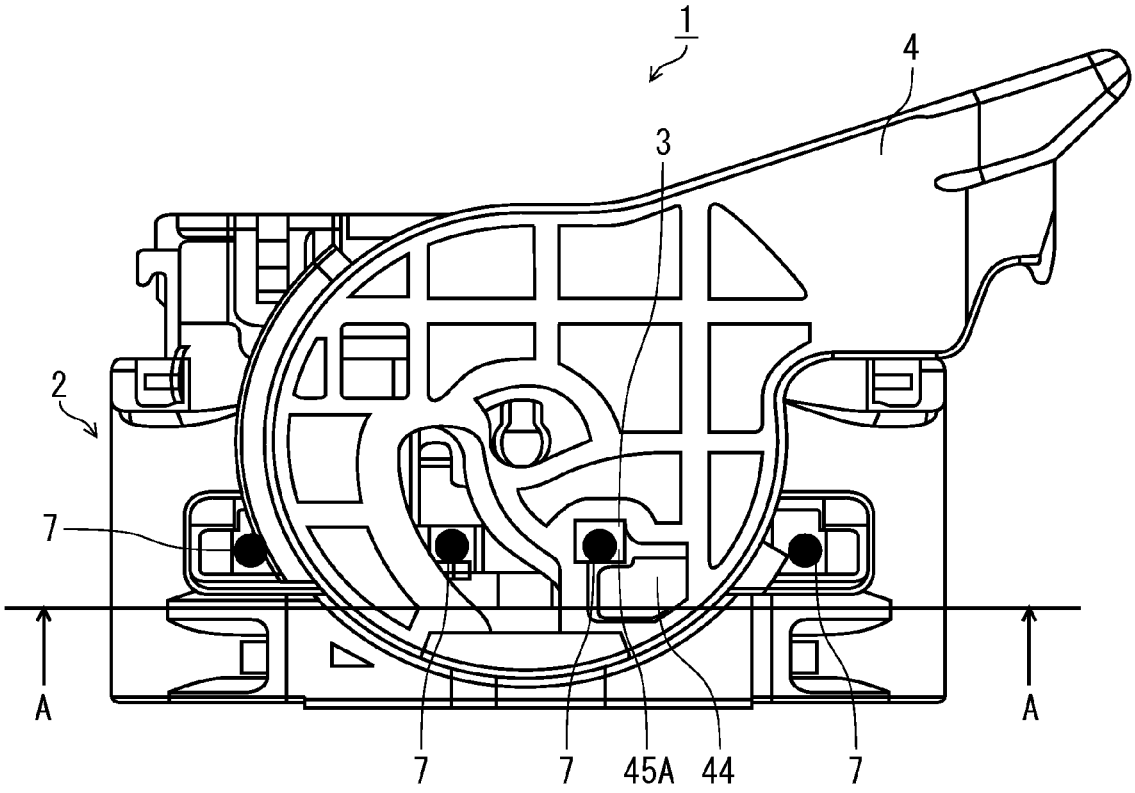
FIG. 5 is a plan view of a lever type connector shown in FIG. 2.
Figure 6:
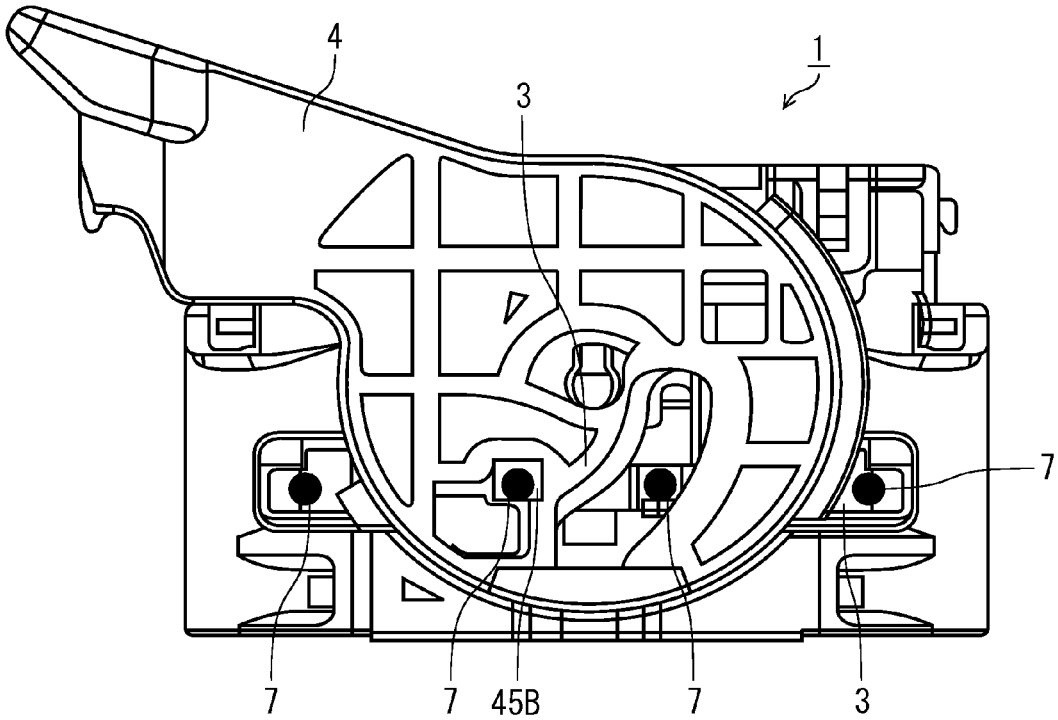
FIG. 6 is a plan view showing such a state that a fitting of a lever of the lever type connector shown in FIG. 2 is reversed bilaterally.
Figure 7:
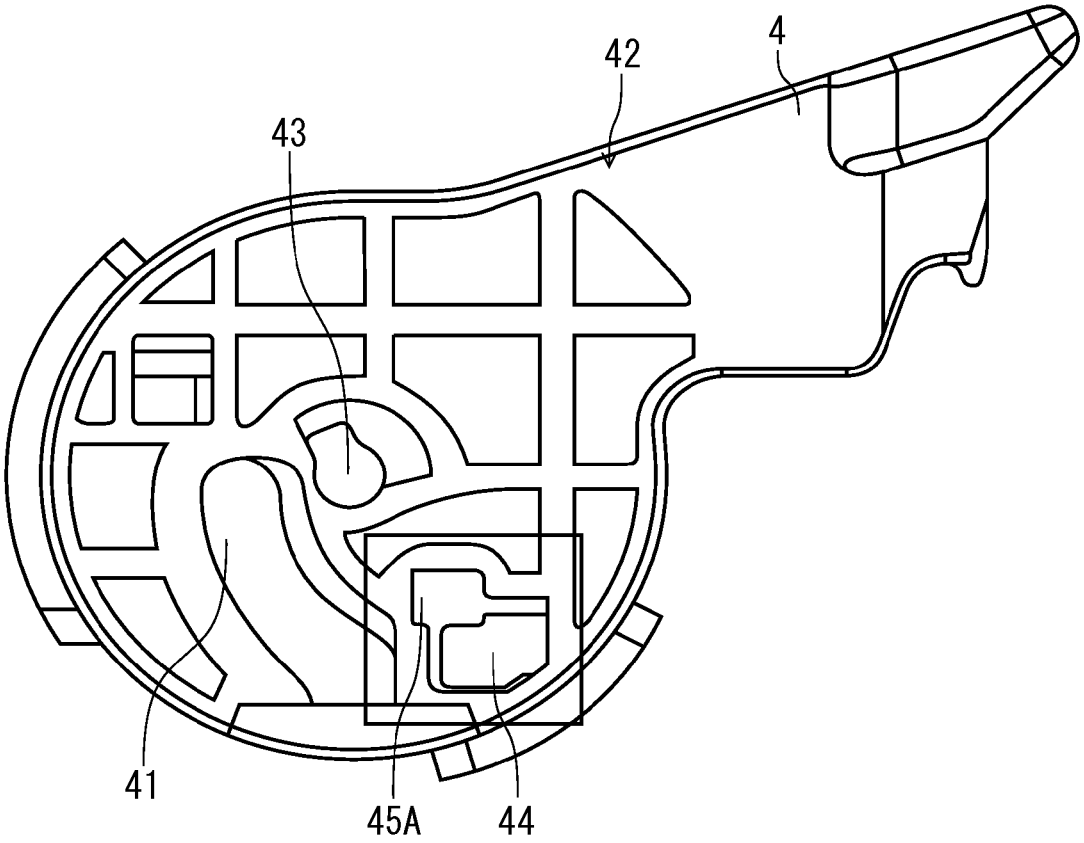
FIG. 7 is a plan view showing a lever of the lever type connector shown in FIG. 1.
Figure 8:
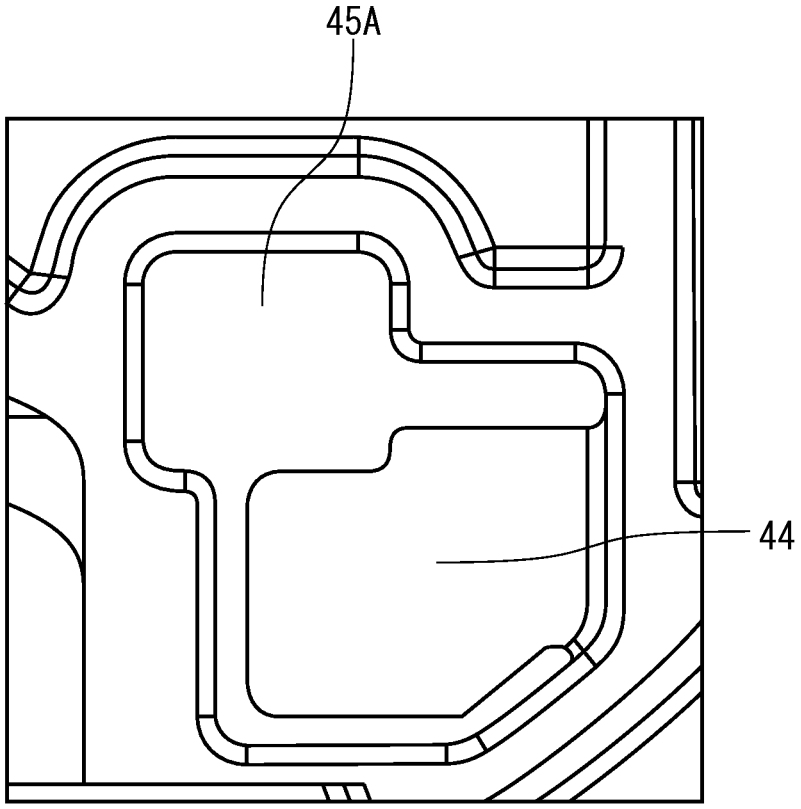
FIG. 8 is an enlarged view of a B portion of a lever of a lever type connector shown in FIG. 7.
Figure 9:
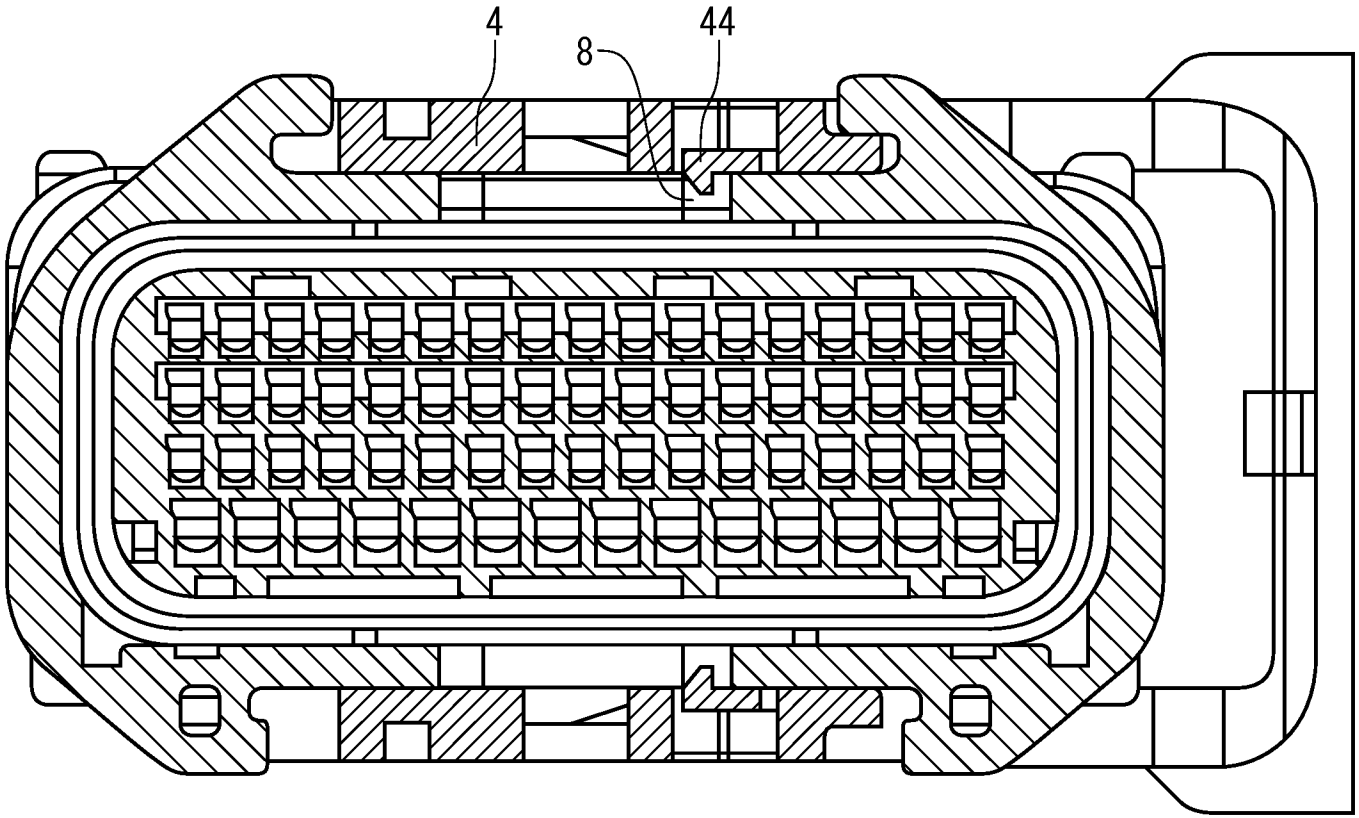
FIG. 9 is an A-A sectional view of a lever type connector shown in FIG. 5.

FIG. 1 is an exploded perspective view showing a lever type connector according to the present invention. FIG. 2 is a perspective view explaining the use of a jig in a state that the lever type connector shown in FIG. 1 is fitted. FIG. 3 is a sectional view showing such a state that a spacer of the lever type connector shown in FIG. 1 is temporarily retained. FIG. 4 is a sectional view showing such a state that a spacer of the lever type connector shown in FIG. 1 is regularly retained. FIG. 5 is a plan view of a lever type connector shown in FIG. 2. FIG. 6 is a plan view showing such a state that a fitting of a lever of the lever type connector shown in FIG. 2 is reversed bilaterally. FIG. 7 is a plan view showing a lever of the lever type connector shown in FIG. 1. FIG. 8 is an enlarged view of a B portion of a lever of a lever type connector shown in FIG. 7. FIG. 9 is a A-A sectional view of a lever type connector shown in FIG. 5.

In FIG. 1, an exploded perspective view of a lever type connector according to the present invention is shown.

In FIG. 1, a level type connector 1 is constructed by a connector housing 2, a spacer 3, a lever 4, and terminals 5.

The connector housing 2 is formed of a synthetic resin, and a spacer inserting port 22 is provided in a connector housing main body 21. This spacer inserting port 22 is used to insert the spacer 3, and the spacer 3 is inserted into this inserting port.

This connector housing 2 is constructed such that this housing can be fitted on an opposite connector housing which may be a male connector housing (not shown). The connector housing 2 is constructed such that the terminals 5 are inserted into a rear end surface of the connector housing main body 21 of the connector housing 2 from the backside.

The connector housing main body 21 is formed like a substantially block shape as a whole. Terminal insertion ports through which the terminal 5 is inserted respectively are formed to open on the rear end surface, and the terminals 5 are inserted into these ports correspondingly. Also, terminal containing cells 23 in which a plurality of terminals 5 are to be contained correspondingly are provided in the connector housing main body 21. The opposite connector housing is fitted attachably to and detachably from the connector housing main body 21.

The lever 4 is operated to couple and decouple the connector housing main body 21 and the opposite connector housing mutually. That is, the lever 4 with a cam groove is fitted turnably to the connector housing 2, and both connector housings are coupled and decoupled mutually when cam pins provided to the opposite connector housing are displaced along cam grooves 41 in accordance with the turning operation of this lever 4.

The spacer 3 is inserted into the connector housing main body 21 through the spacer inserting port 22 that is formed in an outer wall 24 of the connector housing main body 21, and then is contained in the retainer containing portion that is provided in the connector housing main body 21.

As shown in FIG. 3, the spacer 3 is retained in a temporarily retaining position in the retainer containing portion in the connector housing main body 21. In other words, the spacer 3 is held in a temporarily retaining state in the state that the spacer 3 and the lever 4 are attached to the connector housing 2, and thus the terminals 5 are not retained yet by the spacer 3 in this state even though the terminals 5 have already been inserted.

In this manner, in the state that the spacer 3 and the lever 4 are attached to the connector housing main body 21, then the terminals 5 are inserted, and then the spacer 3 is held in a temporarily retaining state in the connector housing main body 21, a jig 6 is inserted in the direction indicated an arrow as shown in FIG. 2 such that pushing pins 62 of the jig 6 are pushed against spacer pushing surfaces 7 on the upper surface side of the spacer 3 correspondingly to push the spacer 3 downward.

When the spacer 3 is pushed down by pushing the jig 6 downward while holding the pushing pins 62 of the jig 6 on the spacer pushing surfaces 7 formed on the upper surface side of the spacer 3, the spacer 3 is shifted from the state that the spacer 3 is retained in a temporarily retaining position, as shown in FIG. 3, to a state that the spacer 3 is retained in a normally retaining state, as shown in FIG. 4, in the retainer containing portion in the connector housing main body 21.

In this manner, the spacer 3 is shifted in the retainer containing portion in the connector housing main body 21 from a state that the spacer 3 is retained in a temporarily retaining state shown in FIG. 3 to a state that the spacer 3 is retained in a normally retaining state shown in FIG. 4. At this time, the terminals 5 are retained in the connector housing main body 21 by this spacer 3, and as a result the terminals 5 are put in a double retaining state in which the retaining given by the spacer 3 is used together with the retaining given by lances. In this way, the drop-off of the terminals 5 can be prevented without fail by the double retaining state that is achieved by the retaining given by lances and the retaining given by the spacer 3.

The lever 4 has the cam grooves 41, and is fitted to extend over the connector housing main body 21. This lever 4 is supported turnably by a pivot 26 that is provided to protrude from a lever fitting surface 25 of the connector housing main body 21 and is formed like a substantially cylindrical shape. When this lever 4 is turned on the pivot 26 on the connector housing main body 21, this lever 4 causes the cam pins provided on the opposite connector housing to displace along the cam grooves 41 respectively, and thus the opposite connector housing can be pulled into the connector housing main body 21.

The fitting of this lever 4 to the lever fitting surface 25 of the connector housing main body 21 is executed as follows. That is, cam plates 42 on both sides in which the cam groove 41 of the lever 4 is formed respectively are spread outward, then the cam plates 42 are pushed into the inside to get over the pivot 26 respectively, and then the pivot 26 provided on the connector housing main body 21 is fitted into socket holes 43 that are provided to centers of the cam plates 42 of the lever 4 respectively, and as a result the cam plates 42 of the lever 4 are supported on the connector housing main body 21 in a disconnection preventing state.

The cam plates 42 of the lever 4 are fitted to sandwich the connector housing main body 21 therein from the upper and lower sides, and are composed of an upper cam plate 42A and a lower cam plate 42B. The upper cam plate 42A and the lower cam plate 42B are constructed such that an arranging configuration of the upper cam plate 42A and an arranging configuration of the lower cam plate 42 are constructed symmetrically with respect to a center plane of the arch shape that puts the connector housing main body 21 between the upper cam plate 42A and the lower cam plate 42.

That is, when the configuration of the upper cam plate 42A when viewed from the top and the configuration of the lower cam plate 42B when viewed from the bottom are arranged side by side, the upper cam plate 42A and the lower cam plate 42B are constructed in axial symmetry.

As shown in FIG. 9, a positioning lock 44 is provided to the cam plate 42 of this lever 4. This positioning lock 44 is retained in a lock retaining portion 8 of the connector housing 2 to temporarily fix the lever 4, as shown in FIG. 9. That is, the positioning locks 44 decide the positions of the cam plates 42 of the lever 4 and temporarily fix the lever 4 at a time when the cam plates 42 of the lever 4 are fitted to the lever fitting surfaces 25 of the connector housing main body 21.

Also, jig passing spaces 45A, 45B are provided in the positioning locks 44 of the cam plates 42 of this lever 4 correspondingly. When the pushing pins 62 of the jig 6 are pushed against the spacer pushing surfaces 7 provided on the upper surface side of the spacer 3 and then the spacer 3 is pushed downward, the pushing pin 62 of the jig 6 penetrates the cam plates 42A, 42B through the jig passing spaces 45A, 45B respectively. The jig passing spaces 45A, 45B are constructed as through holes that pass through the cam plates 42A, 42B of the lever 4 respectively.

In the configuration of the upper cam plate 42A and the configuration of the lower cam plate 428 constructed in this manner, a position of the jig passing space 45A when the upper cam plate 42A is viewed from the top is the same as a position of the jig passing space 45B when the upper cam plate 42B is viewed from the bottom.

Meanwhile, the jig 6 is constructed by a jig main body 61 which is shaped like a rectangle and whose length is substantially equal to the spacer 3, and the rod-like pushing pins 62 provided on the lower surface side of the jig main body 61 to protrude downward from the jig main body 61. The pushing pins 62 of this jig 6 are pushed against the spacer pushing surfaces 7 on the upper surface side of the spacer 3 to push the spacer 3 downward. The pushing pins 62 of this jig 6 are provided to the jig main body 61 in bilaterally symmetrical positions with respect to a line that intersects with the longitudinal direction of the spacer 3, i.e., the longitudinal direction of the jig main body 61, and passes through a center of the jig main body 61.

In other words, the space in which the positioning lock 44 of the lever 4 is to be formed is set in the bilaterally symmetrical positions respectively, and is provided as the jig passing space 45. As a result, as shown in FIG. 5, the spacer pushing surfaces 7 formed on the upper surface side of the spacer 3 can be used at four locations.

As described above, the pushing pins 62 of this jig 6 are provided in the positions that are bilaterally symmetrical with respect to the line that intersects with the longitudinal direction of the jig main body 61 and passes through a center of the jig main body 61. Therefore, even though the right and left sides of the jig 6 are mixed up in use in the situation that the pushing pins 62 of the jig 6 are pushed against the spacer pushing surfaces 7 formed on the upper surface side of the spacer 3 and then the spacer 3 is pushed downward, the pushing pins 62 of the jig 6 can be pushed regularly against the spacer pushing surface 7 formed on the upper surface side of the spacer 3, and thus the spacer 3 can be pushed downward. As a result, the connector housing main body 21 is never scratched by the pushing pins 62 of the jig 6.

Also, the same jig 6 can deal with such a situation that the fitting position of the upper cam plate 42A of the lever 4 and the fitting position of the lower cam plate 42B are reversed in the fitting operation.

It is of course that the present invention can be carried out variously within a scope that does not exceed a gist of the present invention.

The present application is based on Japanese Patent Application No. 2010-162459 filed on Jul. 20, 2010, the contents of which are incorporated herein by way of reference.

INDUSTRIAL APPLICABILITY

The present invention is extremely useful in providing a lever type connector capable of preventing the housing connector from being scratched by a jig for pushing the spacer.

REFERENCE SIGNS LIST

1 level type connector
2 connector housing
3 spacer
4 lever
5 terminal
6 jig
7 spacer pushing surface
8 lock retaining portion
21 connector housing main body
22 spacer inserting port
23 terminal containing cell
24 outer wall
25 lever fitting surface
26 pivot
41 cam groove
42 cam plate
42A upper cam plate
42B lower cam plate
43 socket hole
44 positioning lock
45 jig passing space
61 jig main body
62 pushing pin

The invention claimed is:

1. A lever type connector, comprising:

a connector housing, configured to be engaged with a mating connecter housing;

a spacer;

a lever, including a cam groove, and turnably attached to the connector housing;

a terminal, configured to be inserted into a rear end surface of the connector housing from a rear side;

a positioning lock, provided in the lever, and configured to temporarily fix the lever to be attached to the connector housing;

a jig pressing space, formed in the positioning lock; and spacer pressing surfaces, provided on an upper side of the spacer, formed in symmetrical positions with respect to a center line of the lever that intersects orthogonally with the jig passing space and a longitudinal direction of the spacer, wherein the connector housing is configured to be coupled and decoupled with the mating connecter housing in accordance with a displacement of a cam pin provided in the mating connecter housing along the cam groove by a turning operation of the lever, and wherein the terminal is inserted into the rear end surface in a state that the spacer and the lever are attached to the connector housing, then the terminal is held in a temporarily retaining state by the spacer, and then the spacer pressing surfaces are pushed down by a jig and thus the terminal is held in a normally retaining state by the spacer, wherein the spacer pressing surfaces are configured to be pushed by pushing pins which are provided on the jig in bilaterally symmetrical positions with respect to a center line that intersects orthogonally with the longitudinal direction of the spacer.

2. The level type connector according to claim 1, wherein the lever is fitted to sandwich the connector housing therein vertically, and an arrangement of an upper surface and an arrangement of a lower surface are constructed symmetrically with respect to a center plane of a sandwiching structure.

* * * * *